US009758976B2

(12) United States Patent
Kreizinger

(10) Patent No.: US 9,758,976 B2
(45) Date of Patent: Sep. 12, 2017

(54) CONCRETE FORMING SYSTEM WITH SCAFFOLD

(71) Applicant: Kenneth Robert Kreizinger, Fort Lauderdale, FL (US)

(72) Inventor: Kenneth Robert Kreizinger, Fort Lauderdale, FL (US)

( * ) Notice: Subject to any disclaimer, the term of this patent is extended or adjusted under 35 U.S.C. 154(b) by 650 days.

(21) Appl. No.: 14/210,592

(22) Filed: Mar. 14, 2014

(65) Prior Publication Data

US 2014/0265027 A1 Sep. 18, 2014

Related U.S. Application Data

(60) Provisional application No. 61/852,433, filed on Mar. 15, 2013.

(51) Int. Cl.

| | |
|---|---|
| ***E04G 11/12*** | (2006.01) |
| ***E04G 17/14*** | (2006.01) |
| ***E04G 11/02*** | (2006.01) |
| ***E04G 11/06*** | (2006.01) |
| ***E04G 11/48*** | (2006.01) |

(52) U.S. Cl.

CPC ..... *E04G 11/12* (2013.01); *E04G 11/02* (2013.01); *E04G 11/06* (2013.01); *E04G 11/48* (2013.01); *E04G 17/14* (2013.01)

(58) Field of Classification Search

CPC ..... E04G 11/067; E04G 11/12; E04G 17/14; E04G 11/02; E04G 11/06; E04G 11/48

USPC ..... 264/31, 33; 425/63; 52/745.05, 745.09; 249/33, 47, 189, 219.1, 219.2

See application file for complete search history.

(56) References Cited

U.S. PATENT DOCUMENTS

| | | | | | |
|---|---|---|---|---|---|
| 778,583 | A | * | 12/1904 | Jarvis | E04G 11/12 249/219.1 |
| 1,538,496 | A | * | 5/1925 | Wells | E04G 17/02 249/192 |
| 1,598,131 | A | * | 8/1926 | Ham | E04G 11/12 249/115 |
| 1,670,057 | A | * | 5/1928 | Alley | E04G 11/12 425/112 |
| 2,301,306 | A | * | 11/1942 | McDonald | E04G 17/14 249/207 |
| 2,451,951 | A | * | 10/1948 | Howat | E04G 9/02 249/115 |
| 2,516,318 | A | * | 7/1950 | Hawes | E04G 11/22 182/129 |
| 2,614,311 | A | * | 10/1952 | Shook | E04G 11/12 249/27 |
| 2,679,872 | A | * | 6/1954 | Sutcliffe | E04G 17/042 249/219.2 |

(Continued)

FOREIGN PATENT DOCUMENTS

FR 3016379 * 7/2015 ..... E04G 17/14

*Primary Examiner* — Michael Safavi

(57) ABSTRACT

A concrete forming system combining the ease of erection and load carrying capabilities of scaffolding with a simplified erection system. Scaffold frames provide the vertical support and walers, supported by and spanning from scaffold frame to scaffold frame, provide the horizontal support. The wet concrete's hydrostatic pressure is placed on the walers, which transfer the load to the scaffold frames that act like trusses. The scaffold frames have at least two legs and are secured at their bottom to perform as a cantilever or, when the hydrostatic pressure is greater, they are secured at their bottoms and tops to perform as a truss fixed at both ends. As such, this forming system does not use form ties which results in an obstacle free form face and facilitates forms that simply hang from the walers.

17 Claims, 10 Drawing Sheets

(56) References Cited

U.S. PATENT DOCUMENTS

| | | | | | |
|---|---|---|---|---|---|
| 2,689,101 | A | * | 9/1954 | Dygert | E04G 17/02 248/217.3 |
| 2,964,294 | A | | 12/1960 | Imonetti | |
| 3,030,061 | A | * | 4/1962 | Jennings | E04G 17/14 248/228.2 |
| 3,584,827 | A | | 6/1971 | Shoemaker | |
| 3,591,123 | A | * | 7/1971 | Edwards | E04G 11/28 249/10 |
| 3,595,514 | A | * | 7/1971 | Sanders | E04G 13/00 249/192 |
| 3,712,576 | A | | 1/1973 | Dagiel | |
| 3,874,627 | A | | 4/1975 | Vaught | |
| 3,945,602 | A | | 3/1976 | Doubleday et al. | |
| 4,290,985 | A | * | 9/1981 | Barale | E04G 11/12 249/219.2 |
| 4,640,491 | A | | 2/1987 | Grist et al. | |
| 4,915,345 | A | * | 4/1990 | Lehmann | E04G 11/062 249/10 |
| 5,233,807 | A | * | 8/1993 | Spera | E04G 11/12 52/837 |
| 5,562,845 | A | | 10/1996 | Miller et al. | |
| 5,956,922 | A | * | 9/1999 | Liuska | E04G 11/065 249/216 |
| 6,193,210 | B1 | * | 2/2001 | Katoh | E04G 17/04 249/192 |
| 6,322,047 | B1 | | 11/2001 | Holmboe, Jr. | |
| 7,066,440 | B2 | | 6/2006 | Titcomb et al. | |
| 7,530,545 | B2 | | 5/2009 | Gillespie et al. | |
| 2008/0173788 | A1 | * | 7/2008 | Brewka | E04G 11/10 249/189 |

* cited by examiner

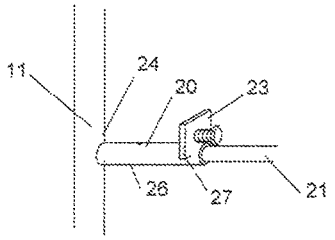
FIGURE 5A
FIGURE 5B
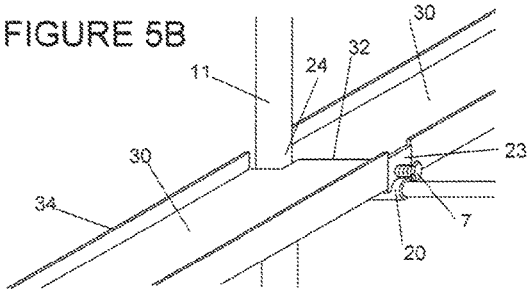
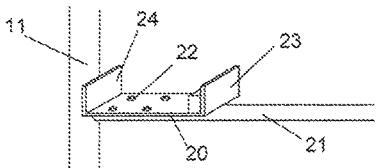
FIGURE 6A
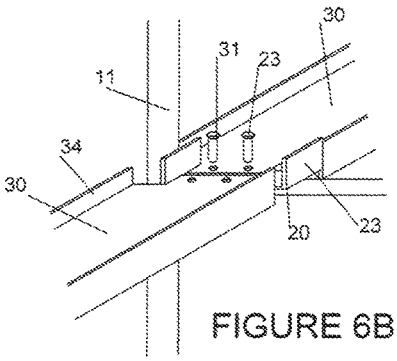
FIGURE 6B
FIGURE 7
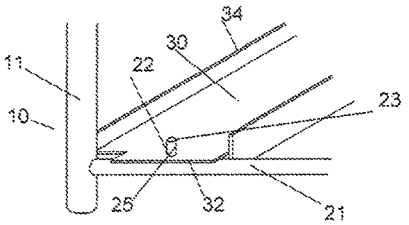
FIGURE 8
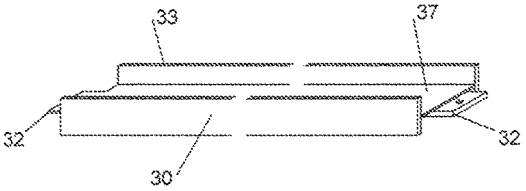

CONCRETE FORMING SYSTEM WITH SCAFFOLD

RELATED APPLICATIONS

This application claims the benefit of the filing date of U.S. Provisional Application No. 61/852,433 filed Mar. 15, 2013 and incorporated herein by reference. This application claims the benefit of copending application Ser. No. 13/374,839 filed Jan. 17, 2012 claiming the benefit of the filing date of provisional application Nos. 61/461,437 filed Jan. 18, 2011 and 61/462,463 filed Feb. 3, 2011. All the above cited applications are incorporated herein by reference.

BACKGROUND OF THE INVENTION

Prior Art

The following is a tabulation of some prior art that presently appears relevant:

| U.S. Patents | | | |
|---|---|---|---|
| Patent Number | Kind Code | Issue Date | Patentee |
| 2,964,294 | | 1960 Dec. 13 | Imonetti |
| 3,584,827 | | 1971 Jun. 15 | Shoemaker |
| 3,712,576 | | 1973 Jan. 23 | Dagiel |
| 3,874,627 | | 1975 Apr. 1 | Vaught |
| 3,945,602 | | 1976 Mar. 23 | Doubleday et al |
| 4,640,491 | | 1987 Feb. 3 | Grist et al |
| 5,233,807 | | 1993 Aug. 10 | Spera |
| 5,562,845 | | 1996 Oct. 8 | Miller et al |
| 6,322,047 | B1 | 2001 Nov. 27 | Holmboe, Jr. |
| 7,066,440 | B2 | 2006 Jun. 27 | Titcomb et al |
| 7,530,545 | B2 | 2009 May 12 | Gillespie et al |

This invention combines the ease of erection and load carrying capabilities of scaffolding with a simplified concrete forming system. The forming system includes scaffold frames as the form's vertical support and walers as the form's horizontal support. It is based upon the two form sides being independent of each other by having minimal or no form ties or other internal bracing extending through the concrete from form side to form side. The scaffold forming system may be used with any type of concrete or other cementicious material although it is best suited for cementicious materials or placement processes that minimize the hydrostatic pressure exerted by the cementicious material when placed inside the forms.

Cast-in-place concrete is well known and widely used throughout the construction industry and considered to be one of the highest quality and more desirable construction systems used today. However, cast-in-place concrete has two major drawbacks. First, it uses internal form ties that extend from form side to form side, through the concrete, to hold the two sides of a concrete from together and are necessary due to the high amount of hydrostatic pressure created by wet concrete in a vertical form. Second, concrete formwork is expensive, due in large part by the use of form ties, and this higher cost results in buildings being built using other materials and/or systems.

The elimination of form ties by using external bracing will not only greatly decrease the cost of cast-in-place concrete, but also remove obstructions inside the form face that cause problems in using form liners or stay-in-place forms. With an obstruction free form face, larger form liners can be quickly, and inexpensively, set in place prior to concrete placement and easily removed after concrete placement. In addition, an obstruction free form face enables stay-in-place wall claddings to be either forms themselves or set inside and be supported by forms and in both cases become permanently bonded to the concrete as it cures and provided an attractive wall cladding.

The scaffold forming system is designed to withstand high amounts of hydrostatic pressure using external bracing only and accomplished by the scaffold frame's depth that can act like a vertical truss spanning from the top to bottom of the form and thereby eliminating the need for form ties. In addition, the forming system can be used with low hydrostatic pressure producing concrete or placement processes, which further reduce the formwork costs.

SUMMARY OF INVENTION

This invention is a forming system for one or both sides of a two sided, concrete forming system used to cast walls, columns and other vertical concrete structures. It combines the ease of erection and load carrying capabilities of scaffolding with a greatly simplified concrete forming system. For purposes of this disclosure the term wall will include columns and other vertical concrete structures.

The forming system includes scaffold frames as the form's vertical support and walers as the form's horizontal support. The scaffold frames act like vertical trusses spanning from the top to the bottom of the structure to be cast. The walers provide horizontal support by spanning from scaffold frame to scaffold frame and thereby transfer any lateral load to the scaffold frames. The scaffold frames, acting like trusses, then transfer that load to the scaffold frame's top and/or bottom which are fixed in place. Since both the scaffold frame and the walers are external braces, they eliminate the need for form ties or other such internal bracing.

The scaffold frame can act as a truss, fixed on both ends (top and bottom) or as a cantilever truss fixed only at its bottom. The key to whether the scaffold frames are fixed at one or both ends and to the spacing of the scaffold frames is the amount of hydrostatic pressure contained inside the forms at any one time. Conventional wet concrete exerts tens of thousands of pounds of hydrostatic pressure on forms and thereby the scaffold frames must be spaced closely together and fixed at the top and the bottom. On the other hand, special concrete or other cementicious mix designs or placement processes can greatly reduce the freshly mixed concrete's hydrostatic pressure and thereby enable the scaffold frames to be spaced further apart and/or be fixed only at their bottom.

One such concrete placement process that minimizes the amount of hydrostatic pressure in the forms is called the Thixotropic Concrete Forming System and is copending application Ser. No. 13/374,839 filed Jan. 17, 2012 and incorporated herein by reference. This new placement process greatly reduces the amount of hydrostatic pressure in a form at any one time and thereby eliminates the need for heavy bracing or form ties. This is accomplished by using the thixotropic properties of no-slump concrete which only exerts hydrostatic pressure when vibrated. Therefore, when using this process, the amount of the hydrostatic pressure in the forms at any one time is minimized by casting no-slump concrete into the forms and minimizing the amount of that concrete being vibrated at any one time. There may be other methods of eliminating or reducing the hydrostatic pressure in cementicious materials and may include the cementicious material envisioned for 3D printing of walls and rapid setting cementicious materials.

The scaffold forming system can be set in place on or adjacent to any surface on which a wall can be cast. The form setting process begins by positioning and securing the scaffold frames directly or indirectly to the surface using base braces. Base braces may be attached to and a part of the scaffold frame or they may be separate devices used to secure a scaffold frame. Typically the base brace on the interior side of the wall is set and aligned first, assuming there is an interior and exterior, to provide a control point to which the exterior base brace can be positioned. The base braces secures the bottom of the scaffold frames and may also be used to brace the bottom of the forms.

Once the bottom of the scaffold frame is secured, its front leg is height adjusted to a predetermined level which sets the wall's casting height. After the scaffold frame's front leg is height adjusted the scaffold frame's second leg is height adjusted to plumb the scaffold frame. The second leg may be secured to the surface or ground or braced at an angle by a third leg to help the scaffold frame resist the lateral pressure. The second and each additional leg act to brace the front leg. The greater the scaffold frame's depth, i.e. distance between the front and the second legs, the stronger it becomes. The scaffold frames are also stack-able to any height and can accommodate scaffold boards.

The scaffold frames are vertically oriented and as each scaffold frame is set in place, it is braced upright by a waler and/or a cross brace attached to an adjacent scaffold frame. The walers can optionally be locked to the scaffold frames and thereby creating a rigid bracing system.

After adjoining scaffold frames are set and adjusted, the remaining walers are set in place and horizontally span from scaffold frame to scaffold frame. The walers are set into saddles attached to the scaffold frame that are designed to brace the walers in a rigid and straight alignment.

Once the walers are secured and aligned, the forms are set in place and in one embodiment, the back of the forms are equipped with a hanging mechanism to enable the forms to simply hang onto the walers. Since the walers are in alignment and the forms have the same depth, the front of the forms will also be in alignment for the concrete. The forms can be attached to one another or they can simply be butted together since the freshly mixed concrete will be fairly dry and thereby not prone to leaking between small form seams. The corner forms may overlap and be butted together or may be attached to one another. The ability to simply hang and butt the forms together greatly speeds the forming and stripping processes.

Each form may be the full height of the wall or the forms may be vertically stacked either before or while the concrete is being placed. When forming for the Thixotropic Concrete Forming System, one side of the forms are fully set before concrete placement while the other side is set in two or more levels during the concrete placement. This results in a short form side that enables visual observation of the vibration and spreading of the no-slump concrete near the bottom of the form, which is very difficult or not possible to see deep down into a tall form.

The Thixotropic Concrete Forming System also minimizes the hydrostatic pressure inside the forms at any one time so that a top form clamp may not be needed and the scaffold frames on both form sides function like a cantilever fixed only at its bottom. When higher levels of hydrostatic pressure are present, a top form clamp is used to tie the two sides together.

Depending upon the amount of hydrostatic and other lateral pressure on the forms, the corners can simply butt together or special corner walers can be used. For example with minimal hydrostatic pressure, the outside corners are such that they allow one corner form and its scaffold frame and walers to extend past the adjacent corner form which butts into the face of the extending form.

When higher, more typical amounts of hydrostatic pressure are present, a special, adjustable corner waler is used. This corner waler fits inside the web of an I-beam waler and easily slides in and out for length adjustment. The corner end connects to the adjacent corner end to form a perfect 90° angle and locks the two sides together. The corner waler can be used for both inside and outside corners.

The scaffold forming system can also be used as formwork for a concrete soffit around the exterior perimeter of the wall. A concrete soffit not only strengthens the wall from lateral forces since it acts like a rib and but it also facilitates placing a concrete roof since the soffit provides the bottom portion of a roof overhang.

BRIEF DESCRIPTION OF THE DRAWINGS

FIG. 5A shows a saddle positioned on a scaffold frame cross bar.

FIG. 5B shows two walers positions inside a saddle and locked into place by a set screw.

FIG. 6A shows another configuration of a saddle with holes into which pins are set.

FIG. 6B shows two walers positioned inside a saddle and two pins are being lowered into the holes to lock the walers to the saddle.

FIG. 7 shows another configuration where a dowel is fixed to the cross bar and the waler has a hole to fit over the dowel to secure the waler.

FIG. 8 shows a waler with flanges and tongues that are set back.

Figure 1A:
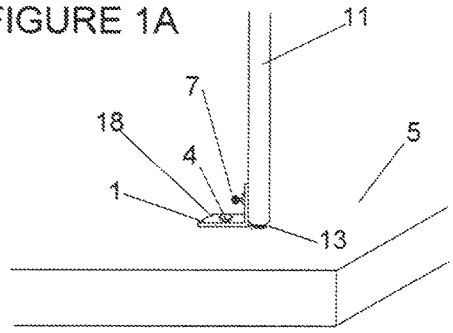
FIG. 1A shows a base brace attached to the scaffold frame and secured to the surface.

DETAILED DESCRIPTION ACCORDING TO THE PREFERRED EMBODIMENTS OF THE PRESENT INVENTION

This invention is a forming system for one or both sides of a two sided, concrete form used to cast walls, columns and other vertical concrete structures. It combines the ease of erection and load carrying capabilities of scaffolding with a greatly simplified concrete forming system that does not utilize form ties or other internal bracing. The forming system includes scaffold frames as the form's vertical support and walers as the form's horizontal support.

When freshly mixed concrete exerts hydrostatic pressure on the forms it pushes the forms outward and therefore the forms must be braced against such pressure. The forms are braced by horizontal walers which in turn are braced by vertical scaffold frames which are also braced. The scaffold frames act like vertical trusses spanning from the top to the bottom of the wall being cast. The walers provide horizontal support by spanning from scaffold frame to scaffold frame and thereby transferring any lateral load to the scaffold frames. The scaffold frames, acting like trusses, then transfer that load to the scaffold frame's top and/or bottom which are secured in place. Therefore, all of the scaffold forming system's bracing is external.

The scaffold forming system is erected by first securing, at predetermined locations, the scaffold frames to the top or the side of the surface on which the wall is being cast. This can be done by directly securing the scaffold frame to the surface using fasteners well known in the art or indirectly by securing the scaffold frame to another device that is directly secured to the surface. For purposes of this disclosure "secure" shall mean to fasten, fix in place or brace and the term "surface" shall encompass a floor, slab, foundation, stem wall and the top of an existing wall or any other structure capable of having a wall built on it.

One embodiment of this invention is the use of base braces 1 to secure one or more scaffold frames 10 to the surface 5. The base brace 1 may be attached to and a part of each scaffold frame 10 or it may be a separate device used to secure one or more scaffold frames 10 to the surface 5. It may be of any size or shape and also perform other functions.

Figure 1B:
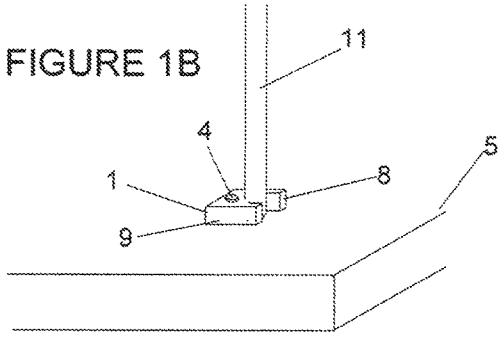
FIG. 1B shows another configuration of the base brace secured to the surface and wrapped partially around the front leg of a scaffold frame.
Figure 1C:
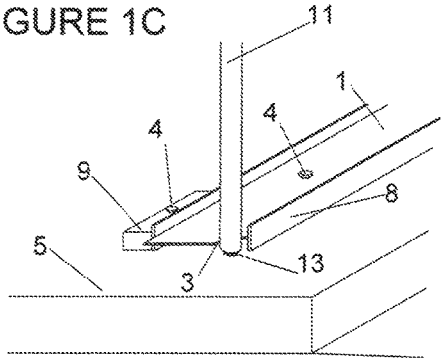
FIG. 1C shows another configuration of the base brace secured by both a block fastened to the surface and by a bolt fastening the base brace to the surface.

FIGS. 1A to 1C show base braces 1 secured to the top of the surface 5 and used to secure the scaffold frames 10. FIG. 1A shows an angle 18, as a base brace 1, fastened to the surface 5 with an anchor bolt 4 and attached to the scaffold frame's front leg 11 through a slot (not shown) and a set screw 7. This slot allows the front leg 11 to be raised by the leveling jack 13 and still be attached to and secured by the base brace 1 (angle 18) which is fastened to the surface 5. FIG. 1B shows a scaffold frame's front leg 11 secured in position by a block 9 acting as a separate base brace 1 and partially wrapping the front leg 1 so that the front side 8 extends in front of the front leg 11. The base brace 1 is secured to the surface 5 with an anchor bolt 4. FIG. 1C shows an elongated base brace 1 secured to the surface 5 by an anchor bolt 4 and also secured by a block 9. This configuration also has a notch 3 cut out of the base brace 1 where the front leg 11 is positioned and secured. The notch 3 is deep enough to enable the front leg 11 to sit back, behind the base brace's front side 8.

Figure 2A:
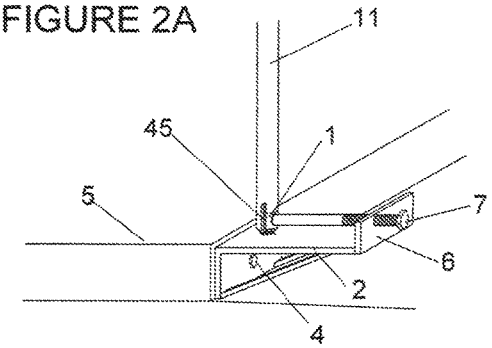
FIG. 2A shows another configuration of the base brace securing the front leg on top of a base plate.
Figure 2B:
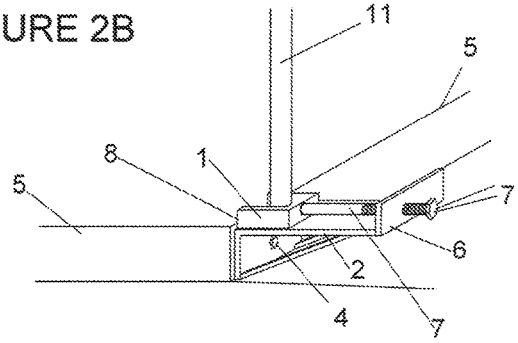
FIG. 2B shows another configuration of the base brace partially wrapping the front leg and secured by a set screw.
Figure 2C:
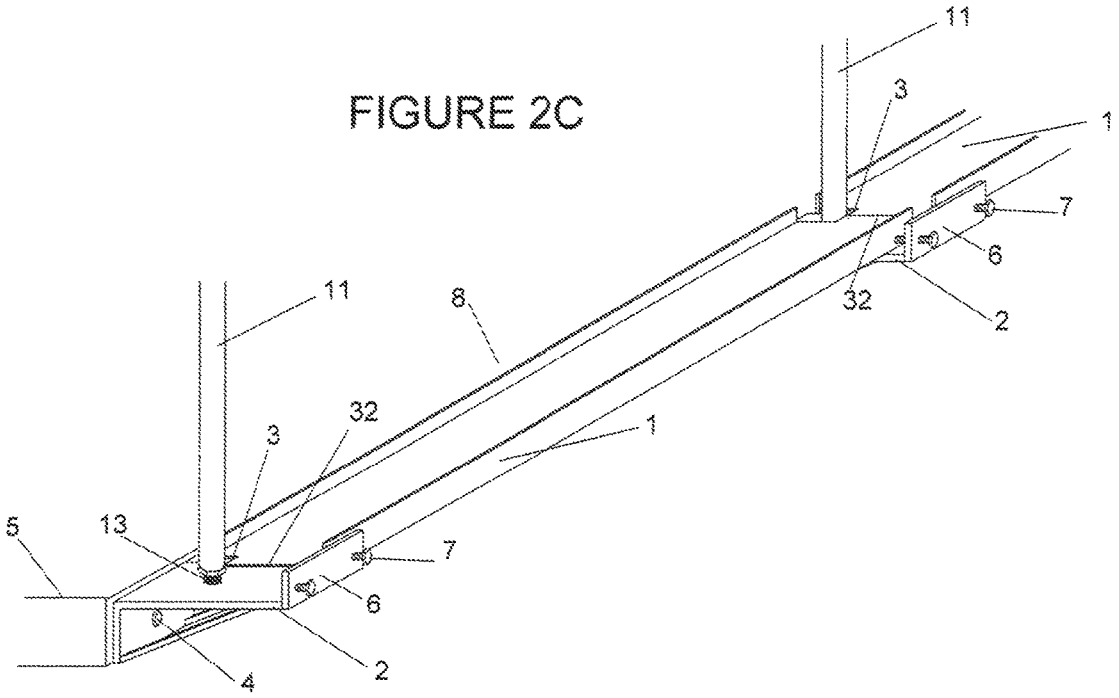
FIG. 2C shows an elongated base brace securing two front legs, one on each end.

The base braces 1 may also be used away from the surface 5 by first attaching a base plate 2 to the surface's 5 side as shown in FIGS. 2A, 2B and 2C. In these configurations, the base plate 2 becomes an extension of the surface 5 on which the scaffold frame's front leg 11 can be supported and secured by the base brace 1. The base plate 2 is attached to the side of the surface 5 with an anchor bolt 4 as shown in FIG. 2A or other means known in the art. The scaffold frame's front leg 11 is then set on the base plate 2 and secured similar to the way it is done on top of the surface 5 as shown in FIGS. 1A, 1B and 1C.

In FIG. 2A slots 45, acting as the base brace 1, are attached to two sides of the front leg 11 to accommodate a set screw 7 that engages the slots 45 and thereby secures the front leg 11 in position. The adjustable set screw 7 is supported by a base plate backstop 6. In another configuration, shown in FIG. 2B, the front legs 11 are secured in position by a block 9 acting as the base brace 1 and wrapping the front leg 11. The set screw 7, supported by the base plate backstop 6, is used to secure the block 9. The block 9 also has a front side 8 that extends in front of the front leg 11.

In FIG. 2C, elongated base braces 1 span from base plate 2 to base plate 2 and are secured by set screws 7 extending from the base plate's backstop 6. The front legs 11 are secured in position by the notches 3 that are cut out of the I-beam used as the base brace 1 in this configuration.

In all of FIGS. 1A through 2C, the front leg 11 has a leveling jack 13 for height adjustment, which may also be done with shims under the front legs 11. By setting all of the scaffold frames 10 to the same height forces the forms to be set at the same height and establishes a level top of wall.

Figure 20:
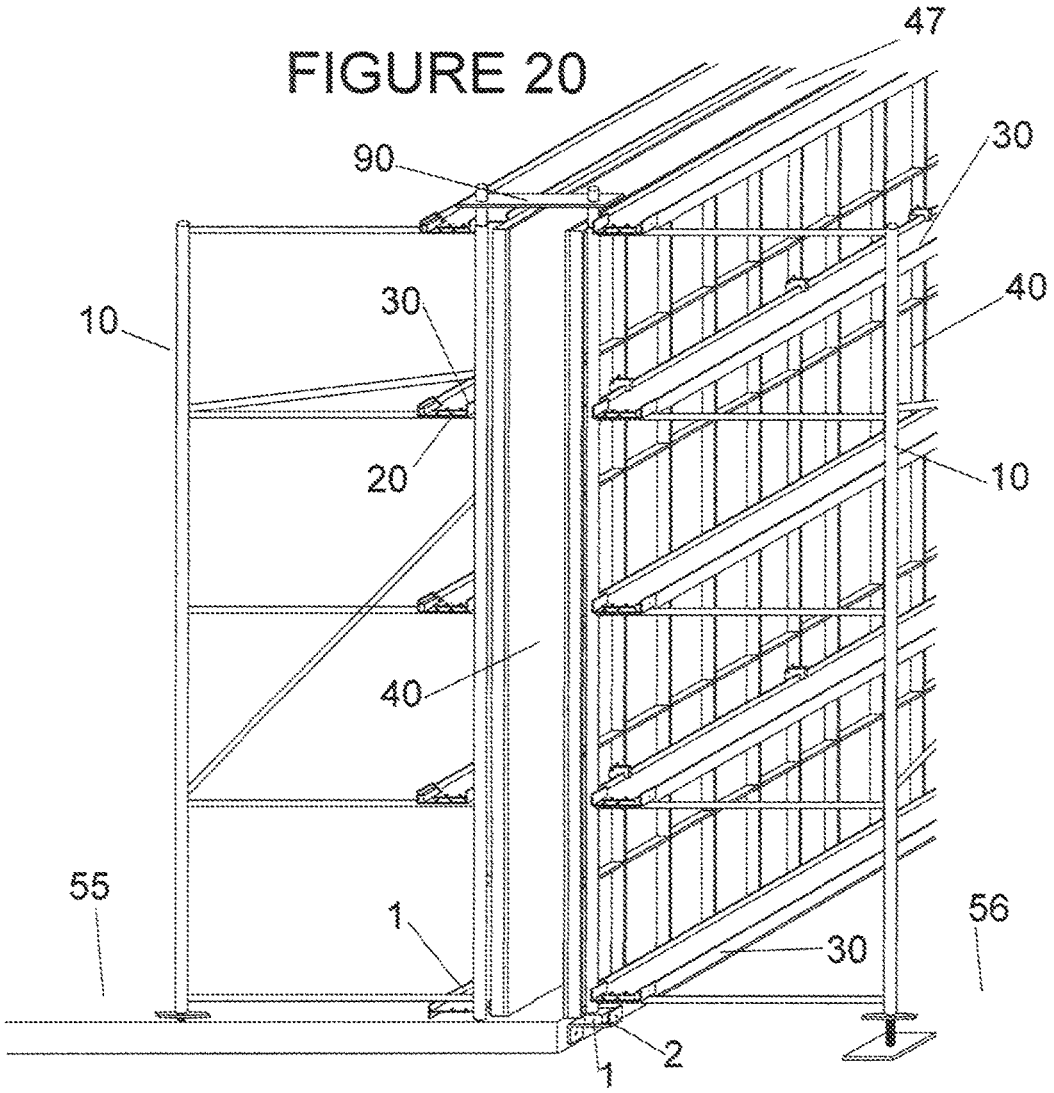
FIG. 20 shows the interior and exterior sides of the forming system ready for concrete with a top clamp attaching the tops of the scaffold frames and base braces securing the bottoms of the scaffold frames.

Depending upon the design, the base braces 1 may also have a front side 8 which aligns the bottom of the forms and comes into direct contact with the backside of the forms and thereby provide the bracing to keep the bottom of the forms in a straight alignment. FIGS. 1B, 1C, 2B and 2C all show how the base brace 1 may wrap part of the front leg 11 and be positioned to brace the forms without interference from the front leg 11. The front side 8 of the base braces 1 are vertically aligned with front side 8 of the walers 30 which are used to horizontally brace the upper sections of the forms. In those instances where the base brace 1 does not brace the bottom of the forms such as in FIGS. 1A and 2A, a waler 30 can be set on the scaffold frames 10 near the surface 5 to brace the bottom of the forms as shown in FIG. 20.

The vertically oriented scaffold frame 10 has two or more legs to facilitate a much deeper scaffold frame, i.e. distance from the front leg 11 to the second or third leg. The greater the scaffold frame's 10 depth, the greater its strength to withstand loads transferred from the walers. Generally, the front leg 11 is in the vertical position and the second leg 12 in either a vertical or a slopped position and braces the front leg 11. Additional legs may also be used in either a vertical or slopped position and provide further bracing to the front leg 11.

Figure 3:
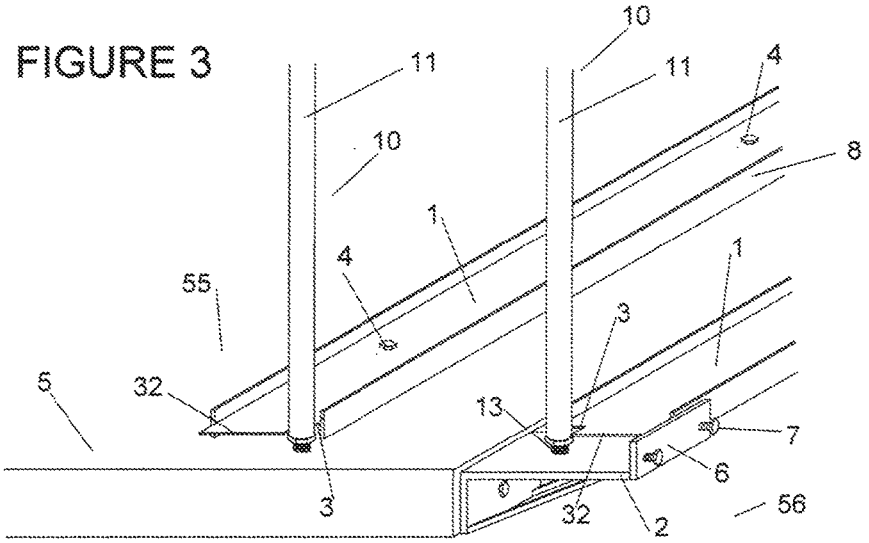
FIG. 3 shows the front legs of an interior and an exterior scaffold frame being secured by an elongated base brace.

Casting exterior building walls is a common application for this forming system and such walls have an interior side 55 having a floor (surface 5) and an exterior side 56 comprised of the ground. FIG. 3 shows the front legs 11 of two opposite scaffold frames 10 being positioned and secured to form two sides of an exterior wall to be cast on the surface's 5 perimeter. One scaffold frame 10 is on the interior side 55 and secured to the top of the surface 5 and the other scaffold frame 10 is on the exterior side 56 and secured on top of the base plate 2 which is attached to the surface's 5 side. Both sides of the wall show the front legs 11 being secured by the notch 3 in the end of an elongated base brace 1, shaped like an I-beam.

Figure 4:
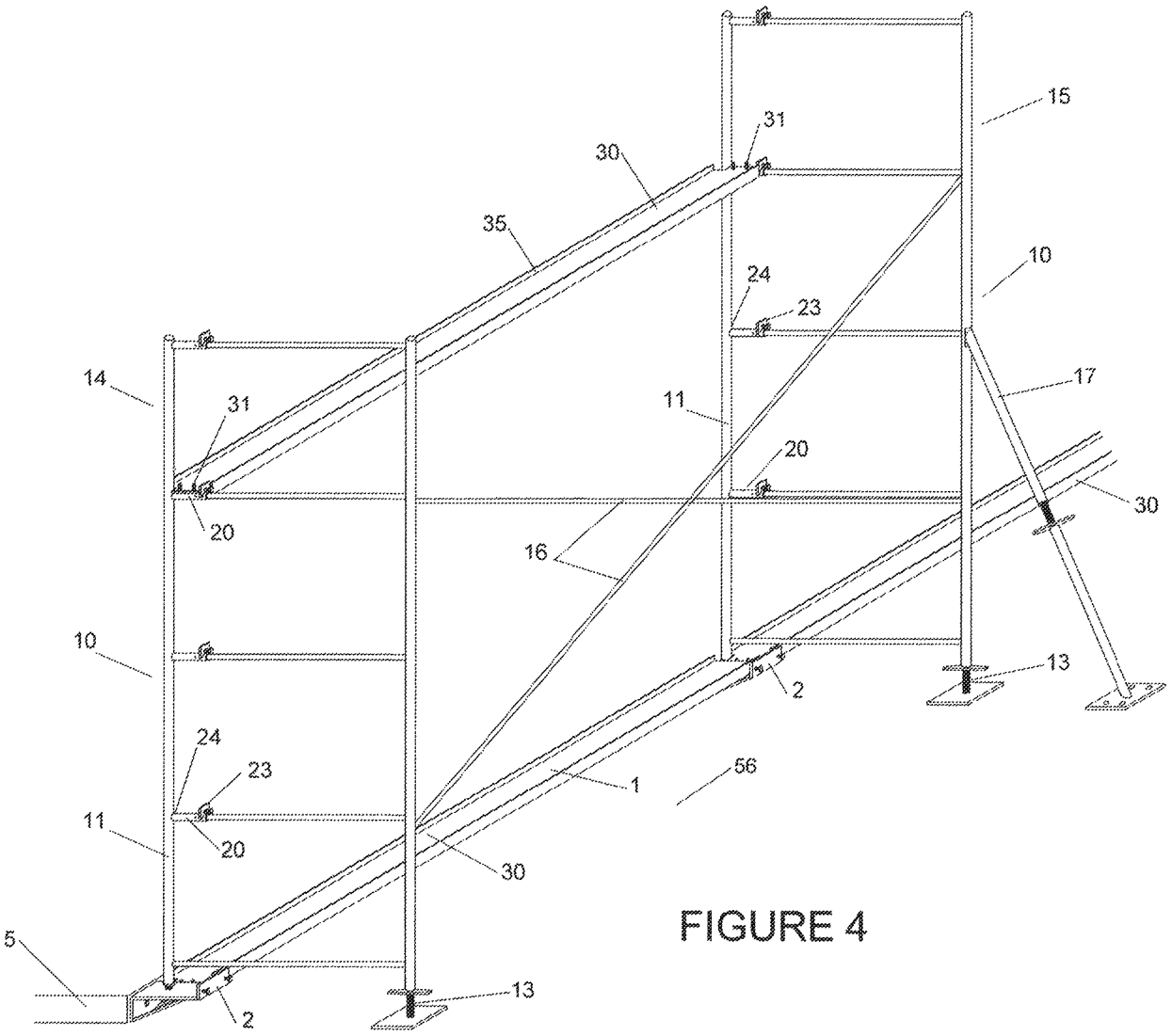
FIG. 4 shows adjacent scaffold frames plumed and braced together and with two walers spanning the scaffold frames.

FIG. 4 shows the scaffold forms 10 erected on the exterior side 56 with the front legs 11 and the second legs 12 in vertical positions while a third leg 17 is in the slopped position, bracing one of the second legs 12, which is bracing the front leg 11. Slopped legs are especially important when the scaffold frames are taller or are stacked for taller walls. Also shown in FIG. 4 is a leveling jack 13 supporting the second leg 12 and used to plumb and level the scaffold frame 10 by adjusting the height of the second leg 12.

After the second scaffold frame 15 is set, a cross brace 16 is attached from the first scaffold frame 14 to the second scaffold frame 15 as shown in FIG. 4. This can be continued for each subsequently set scaffold frame 10 in a line and has the effect of helping to square each newly set scaffold frame 10 in alignment with the prior set scaffold frames 10.

After cross bracing the first two scaffold frames, an optional locking waler 35 is attached from the first scaffold frame 14 to the second scaffold frame 15 as shown in FIG. 4. This is repeated for each subsequent scaffold frame 10 set in the line of forms. The locking waler 35 is a typical waler 30 except that it is preferably locked to each scaffold frame 10 with pins 31 or other means for fixing the walers to the scaffold frame including set screws, dowels, notches, wedges and other means known in the art. The locking waler 35 provides lateral bracing to the scaffold frames 10 and sets the precise distance from one scaffold frame 10 to the next so that the placement of the remaining walers 30 is greatly simplified. In addition, by firmly securing the locking waler 35 to the scaffold frame 10 it forces an alignment of the scaffold frames 10.

The scaffold frame 10 is used to keep the cast-in-place concrete wall plumb and to support and brace the walers 30 that are used to support the forms. The scaffold frames 10 may also be used as scaffolding to support workers.

The primary purpose of all walers is to provide an elongated, continuous horizontal support to the forms and thereby they must be sufficiently rigid to withstand the lateral pressure exerted on the forms over the span from scaffold frame to scaffold frame. As such, the walers may be made of any sufficiently strong materials and profile.

Since the scaffold frames are set apart in predetermined locations, the wales 30 are elongated and span the distance between adjacent scaffold frames 10 and are connected to the scaffold frames 10 by saddles 20. The scaffold frames 10 have two or more saddles 20 spaced vertically apart that are used to connect the ends of the walers 30 to the scaffold frame 10 to facilitate the transfer of the lateral loads, i.e. hydrostatic pressure, wind, etc., placed on the walers 30 to the scaffold frames 10. The saddles 20 provide the walers 30 with both vertical and horizontal support with the vertical support simply a surface on which the walers are laid. The horizontal support against the lateral pressure is by backstops 23 that are part of the saddle 20 and secure the waler 30 from being pushed away from the concrete pressure.

In one configuration the walers 30 are I-beams with the flanges 33 removed at both ends to create tongues 32 protruding from the web 37 at the ends as shown in FIGS. 5B, 6B and 7. The tongues 32 sits on the saddle 20 and are secured by the backstop 23. In addition, the notch 3 may be cut of the web 37 to enable the front leg 11 to sit back, away from the front side 8. The tongues 32 may either overlap one another on the saddle 20 as shown in FIG. 5B or they butt up to one another on the saddle 20 as shown in FIG. 6B. In either case, the walers 30 are supported by the saddles 20 and form a continuous line along at least one side of the wall being cast.

FIG. 5A shows one saddle 20 configuration where the saddle front 24 is the front leg 11 and the backstop 23 is a flange 27 mounted on a sleeve 26 that wraps the scaffold frame's cross bar 21. The saddle's front 24 and back 23 are set apart by a distance slightly greater than the width of the waler 30 or the waler's tongue 32 that fits between the two as shown in FIG. 5B. This distance facilitates easy placement and removal of the walers.

In another configuration the walers 30 are secured to the saddle 20 by a set screws located in the saddle's backstop 23 as shown in FIGS. 5A and 5B. The set screw 7 applies pressure against the two tongues 32 from adjacent walers 30 and thereby firmly secures the walers 30 between the set screw 7 and the saddle's front 24. When a set screw 7 is not used, the concrete pressure pushes the waler 30 outward until it is stopped by the backstop 23 which then braces the waler 30 from being pushed any further and transfers the waler's 30 load to the scaffold frame 10. After the concrete hardens, the waler 30 is easily removed by loosening the base braces 1 and/or base plates 2 which causes the formwork to be loosened from the cast wall.

In another configuration, a channel section is used as the saddle 20 as shown in FIG. 6A, with a front 24 and a backstop 23 and optional holes 22 for securing the walers to the saddle. In this configuration a longer saddle 20, i.e. the saddle's length perpendicular to the scaffold frame, enables the waler's 30 ends, or tongues 32 to butt up to each other as shown in FIG. 6B, as opposed to the tongues 32 overlapping as shown in FIG. 5B. Optional pins 31 may also be used to secure the walers 30 in the saddle 20 or the waler 30 can press upon the saddle's backstop 23 for bracing against the concrete's pressure. When pins 31 are used they are also considered to be backstops 23 since they secure the waler 30 from being pushed outward, away from the concrete.

The saddle's backstop 23 may be a fixed vertical member such as a dowel or flange or it may be one or more removable pins. FIG. 7 shows another configuration wherein a saddle 20 is created by fixing a dowel 25 to the cross bar 21 and the holes 22 in the tongues 32, or waler's end, slips over the dowel 25 to secure the waler 30 to the scaffold frame 10. The front leg 11 is the saddle's front 24 and the dowel 25 is also the backstop 23 that secures the waler's 30 horizontal movement. If a second pin 31 or dowel 25 are inserted, it will have the effect of greatly stiffening adjoining scaffold frames 10 together.

The walers 30 horizontal support may be either contained by or fixed to the saddles 20 and this distinction greatly affects the waler's 30 strength. When the walers 30 are contained, there is a small amount of space inside the saddle 20 for the walers to move or rotate horizontally and as the concrete pressure pushes the walers 30 outward, the walers 30 are pressed up against the saddle's backstop 23 which prevents further horizontal movement. Fixing the walers 30, on the other hand, locks the walers in place and prevents any horizontal movement by using pins, set screws, dowels, notches, wedges, and other means known in the art. Fixing a waler 30 into the saddle 20, greatly increases the waler's strength and enables it to withstand higher level of concrete's pressure or span longer distances.

In another configuration each row of walers 30 are in the same plane to provide consistency and to simplify the form attachment. In order to accomplish this the tongues 32 must either butt up to each other in the saddles 20 or one tongue must be above the other such that they overlap in the saddle 20. The tongues 32 can overlap by attaching a protruding plate 36 to the top or bottom of the waler's web 37 on one end of the waler 30 and notching the waler's flange 33 on the second end so that the web protrudes as the tongue 32 as shown in FIG. 8. This will allow the tongue 32 on one waler 30 to sit on top of the tongue 32 of an adjoining waler 30 in the saddle 20 area while maintaining the walers 30 in the same horizontal plane.

In one preferred embodiment, the walers 30 are I-beams having a flange 33 that extends upright, as shown in FIG. 8. The flanges 33 provides vertical strength to the walers for longer spans between scaffold forms 10 and also a convenient method of attaching the forms to the walers 30 as disclosed below. It will be obvious that other materials and profiles may also be used as walers 30 although their interaction with the saddles and attachment to the forms may be slightly different.

Figure 9:
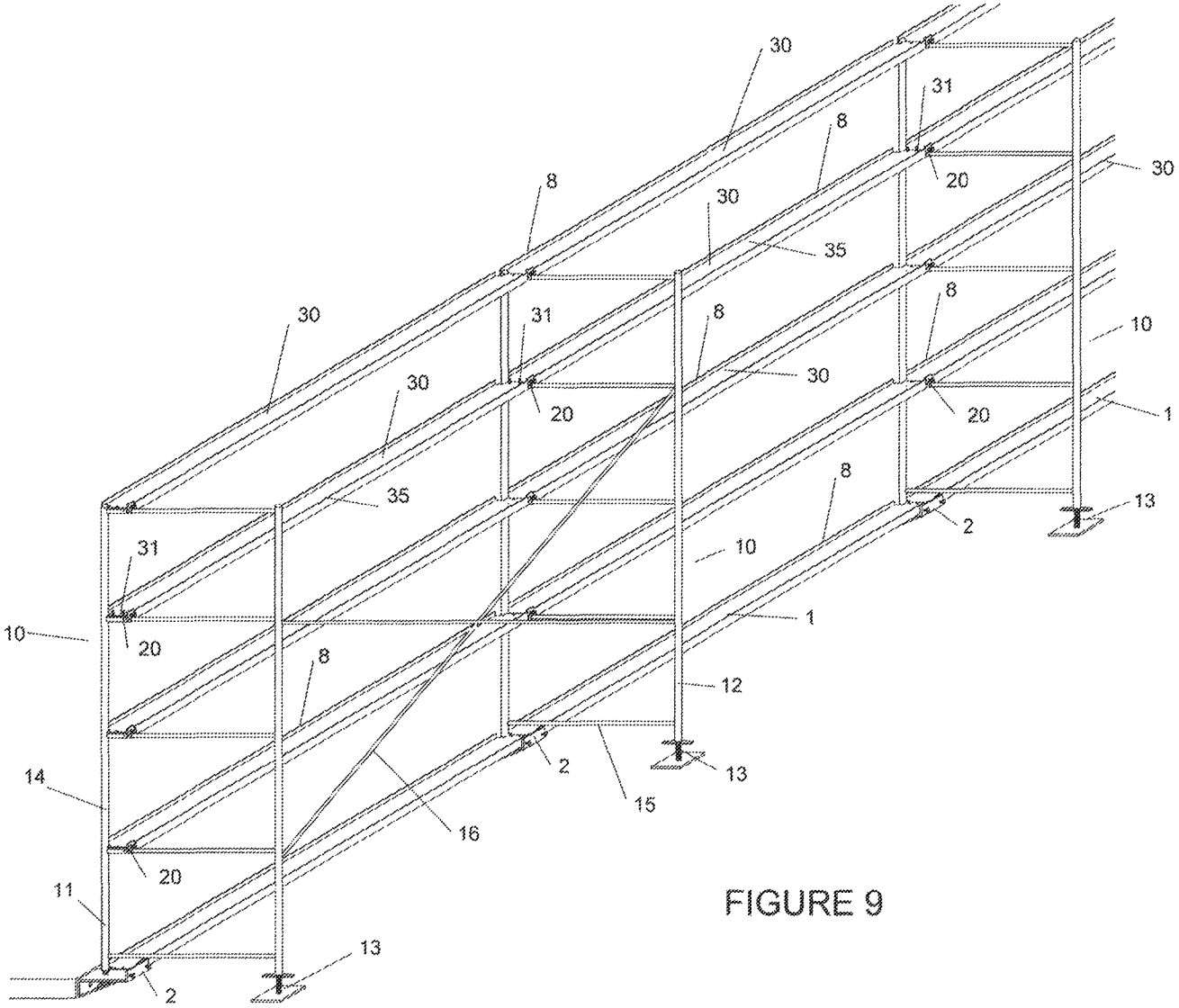
FIG. 9 shows an erected tall form side ready for hanging the forms.

FIG. 9 shows multiple scaffold frames 10 mounted on base plates 2 and leveling jacks 13 on the exterior side 56 and ready for the forms. All of the walers 30 have been placed including the base braces 1 and the locking walers 35 and the waler's 30 and base brace's 1 front sides 8 are in vertical alignment to support the forms. A cross brace 16 may be used for all scaffold frames 10 or only to square the first scaffold frame 14 to the second scaffold frame 15, which squares the subsequent scaffold frame when the walers are fixed in the saddles. The locking walers 35 each have two pins 31 fixing them to their respective saddles 20 and causing the entire system to be rigid, straight and plumb.

Another embodiment of this invention is the forms 40 which can be vertically or horizontally oriented (taller than wider or wider than taller). The forms 40 butt together on their sides and may have edges that overlap and may also be clamped together from their backsides 41. The forms' backsides 41 are positioned against the walers' 30 and base brace's 1 front sides 8 which are in vertical alignment. The forms 40 are attached to the walers 30 by fasteners 42 positioned on the form's backside 41.

The form's face 47 of this invention is obstacle free, which means there are no form ties extending through or between the form faces 47. This requires the forms 40 to be attached to the walers 30 from the form's backside 41 for horizontal bracing and vertical support. A variety of forms known in the art may be used to accomplish this including plywood and there are several methods known in the art that may be used to attach the forms 40 to the walers 30 such as screwing a screw through a hole in the waler's front flange 34 into the form's backside 41 or using a hook attached to the backside 41 that hooks over all or part of the waler 30.

Figure 11:
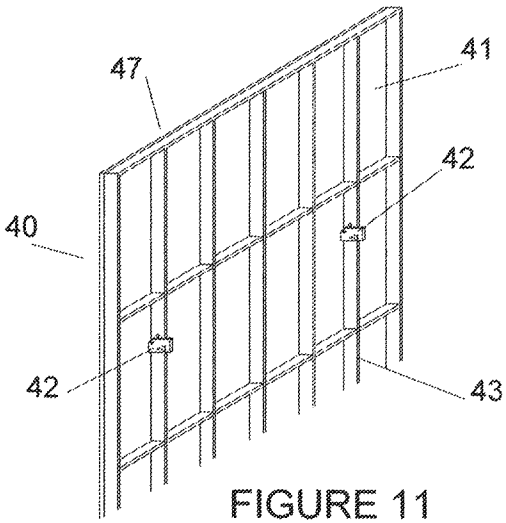
FIG. 11 shows the same form as shown in FIG. 10 except the fasteners are in the open position and ready for hanging the form on the walers.
Figure 10:
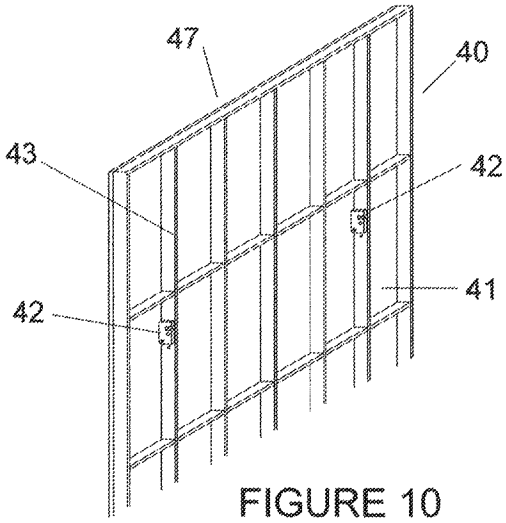
FIG. 10 shows the backside of a hanging form with the fasteners in the closed position.

FIG. 10 shows a form 40 reinforced by ribs 43 on the backside 41 and further having a multitude of fasteners 42, that are folded into the ribs 43 while the form 40 is handled and stored. FIG. 11 shows this same form 40 with the fasteners 42 opened and protruding from the form's backside 41 and ready for attachment to the walers 30 by being hung onto the walers 30. There are a variety of ways known in the art that may be used for form 40 attachment by hanging the backside 41 of the form 40 onto the walers including permanent or removable, fixed or adjustable and may be folded away for storage on or into the backside 41. The ability to simply hang the form 40 onto the walers 30 for attachment greatly simplifies the form 40 erection and stripping processes.

Figure 12B:
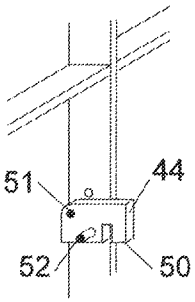
FIG. 12B is a closeup of the fastener in the open position.
Figure 12A:
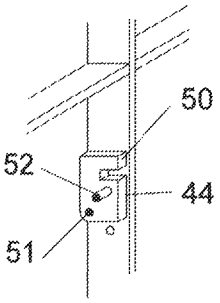
FIG. 12A is a close up of the fastener in the closed position.

For example, FIG. 12A shows a latch 44 in the closed position and FIG. 12B shows the same latch in an opened position. In this configuration the latch 44 has a hooked end 50 and rotates from opened to closed on a fixed pin 51. A removable pin 52 holds the latch 44 in either the closed or opened position.

Figure 13:
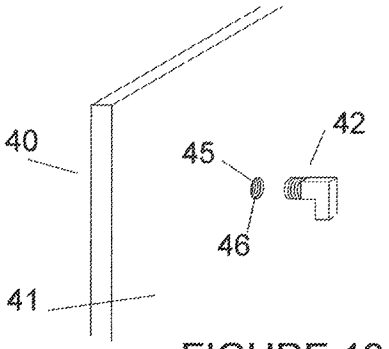
FIG. 13 is another configuration of the fastener that screws into the back of a form.

The hanging forms may be reinforced with ribs 43 or may be solid as shown in FIG. 13. In this configuration a solid form 40 with a backside 41 has a slot 45 into which an anchor 46 has been inserted to accept a fastener 42. The anchor 46 and the fastener 42 may have a means for connection including threads, quarter turns, ball-lock pins and similar devices that are well known in the art. These removable fasteners 42 can be quickly connected to the backside 41 before erection and then quickly removed during form stripping.

Figure 15:
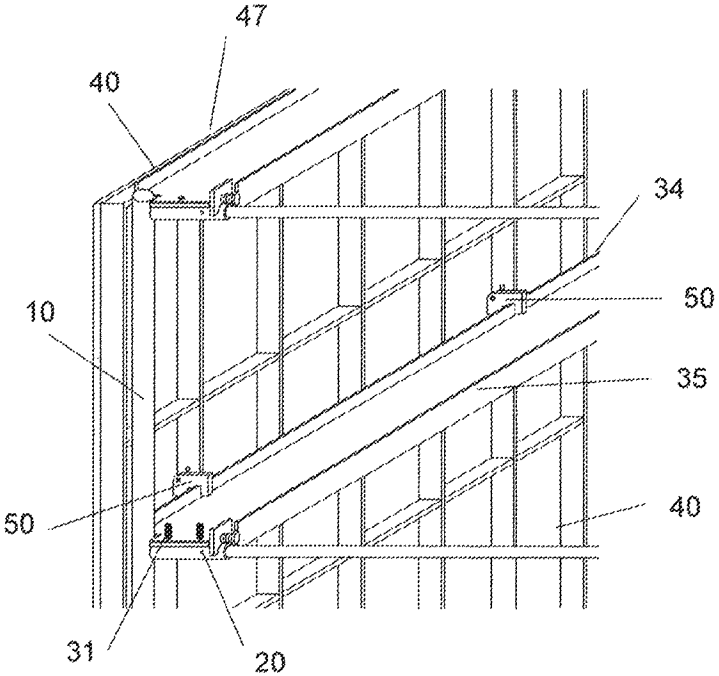
FIG. 15 shows a close up of FIG. 14.
Figure 14:
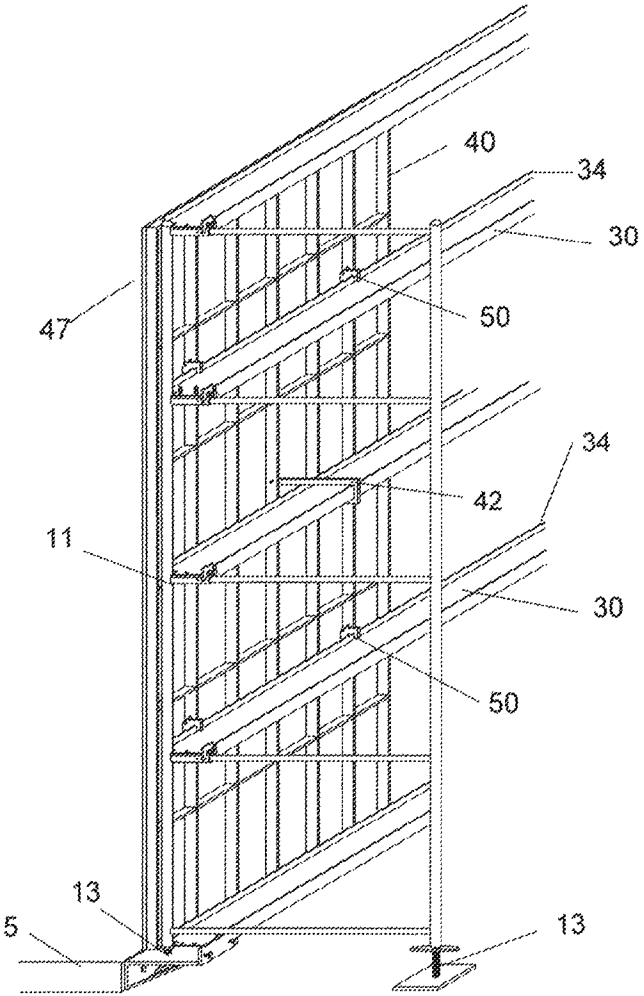
FIG. 14 shows a tall form with the fasteners open and hanging on the walers.

FIGS. 14 and 15 shows a ribbed form 40 attached to the walers 30 by being hung onto two walers 30. The latch hook 50 fits over the waler's front flange 34. The walers 30 are of sufficient strength to hold the forms 40 level, with the top of form elevation having been determined by the setting of the leveling jacks 13 in the front leg 11. FIG. 15 is an enlarged area of FIG. 14 showing the pins 31 fixing the locking waler 35 to the scaffold frame 10 and the latch hook 50 fitting over the waler's front flange 34.

In another configuration for attaching the forms to the walers, longer fasteners 42 are attached to the form's backside 41 that are capable of reaching over or through a square or rectangular waler 30 several inches wide. FIG. 14 shows one such longer fastener 42 that reaches over the full width of the waler 30 to attach the form's backside 41. The fasteners 42 may be of any type that are capable of attaching the form's backside 41 to the walers 30.

Figure 16:
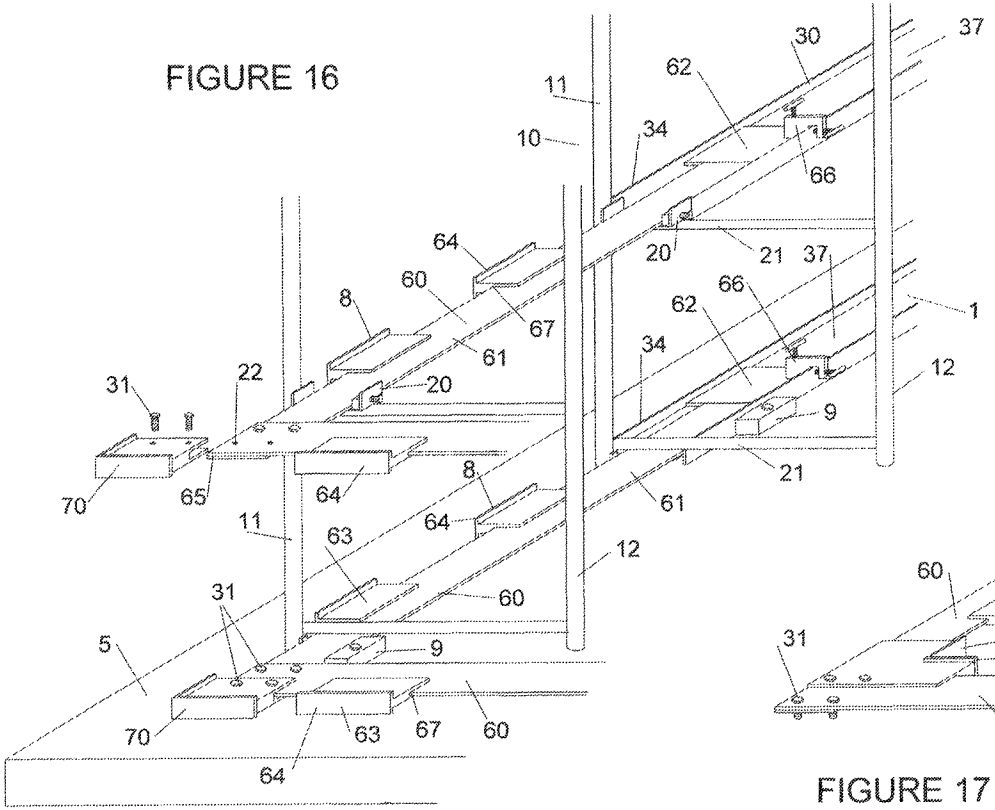
FIG. 16 shows the corner waler with blocks to provide the bracing for an inside corner.

Another embodiment of this forming system is a special corner waler that is quickly set, easily adjustable and forces square corners. FIG. 16 shows the base braces 1 held in place by a block 9 on a surface 5 and a second row of walers 30 held in place by saddles 20 on scaffold frames 10. The corner walers 60 have a flat body 61 of uniform width equal to that of the waler's tongue 32 so that the body 61 may sit inside the saddle 20. The corner walers 60 also have a wider head 62 equal to the inside width of the waler's web 37. This causes the wider head to be wedged between the flanges 34 and the flat body 61 to be wedged inside the saddle and results in the corner walers 60 being in general alignment with the base brace 1 and/or the walers 30. This alignment becomes perfectly straight when the holes 22 at the end of a first corner waler 60 are pinned or otherwise connected with the holes of a second corner waler 60 after the second corner waler's 60 length is adjusted accordingly.

The corner waler 60 may be of any fixed length and is easily shifted inside the web 37 until the desired length from the saddle 20 to the corner 65 is reached. When the corner waler 60 is set, a clamp 66 is positioned over the head 62 to firmly fix the head 62 against the inside of the web 37. FIG. 16 also shows extension blocks 63 having a "T" front 64 with the front side 8 aligned vertically with other "T" front's 64 front side 8 and aligned horizontally in the same plane as the base brace's 1 or waler's 30 front side 8. The extension blocks 63 have a slot 67 with a top and bottom that fits over a portion of the flat waler body 61 so as to hold the extension block in place and extend the front side 8 into alignment with the other front sides 8.

At the corner 65 where the corner walers 60 intersect at a 90 degree angle, one corner waler 60 sits on top of the second and pins 31 are set into two or more holes 22 to lock the corner walers 60 together. The slot 67 of an outside corner block 70 is fit over the two corner walers 60 and pins 31 are inserted into holes 22 so as to connect the outside corner block 70 to the two corner walers 60. This has the effect of producing a 90 degree corner while locking two intersecting lines of walers together.

Depending upon the distance from the waler 30 to the corner 65, one or more scaffold frames 10 may be used to support the corner waler 60 near the corner 65. The corner walers 60 are secured in position by base plates 1, blocks 9 or saddles 20 as the case may be. The corner walers 60 are fixed in position by the combination of the head 62 being held inside the web 37 by the clamp 66 and either a base plate 1, block 9, or saddle 20 firmly securing the body 61 and finally by the pins 31 locking the intersecting corner walers 60 together in a 90 degree angle, all shown in FIG. 16.

Figure 17:
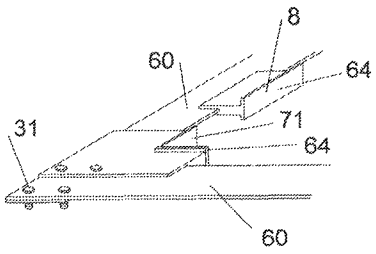
FIG. 17 shows the corner waler for an outside corner.

The corner walers 60 and the extension blocks 63 may be used on the interior and exterior side of a wall and also for outside or inside corners. FIG. 17 shows an inside corner block 71 secured to two corner walers 60 with pins 31 so that the "T" front 64 creates an inside, 90 degree corner for the forms.

Another embodiment of this forming system is that the scaffold frame on one side of the wall can be completely independent from the forming system on the other side of the structure. The scaffold frame is vertically and horizontally self braced and needs no support or other bracing from either the forming system on the other side of the wall or any embedments in the structure. As such, the scaffold frames on the two sides of a wall being cast are completely independent of each other. There are several advantages of this, one of which is that the formwork and/or bracing on one or both sides of the wall can be set during the casting of the wall, to facilitate the Thixotropic Concrete Forming System's concrete placement process.

Figure 18:
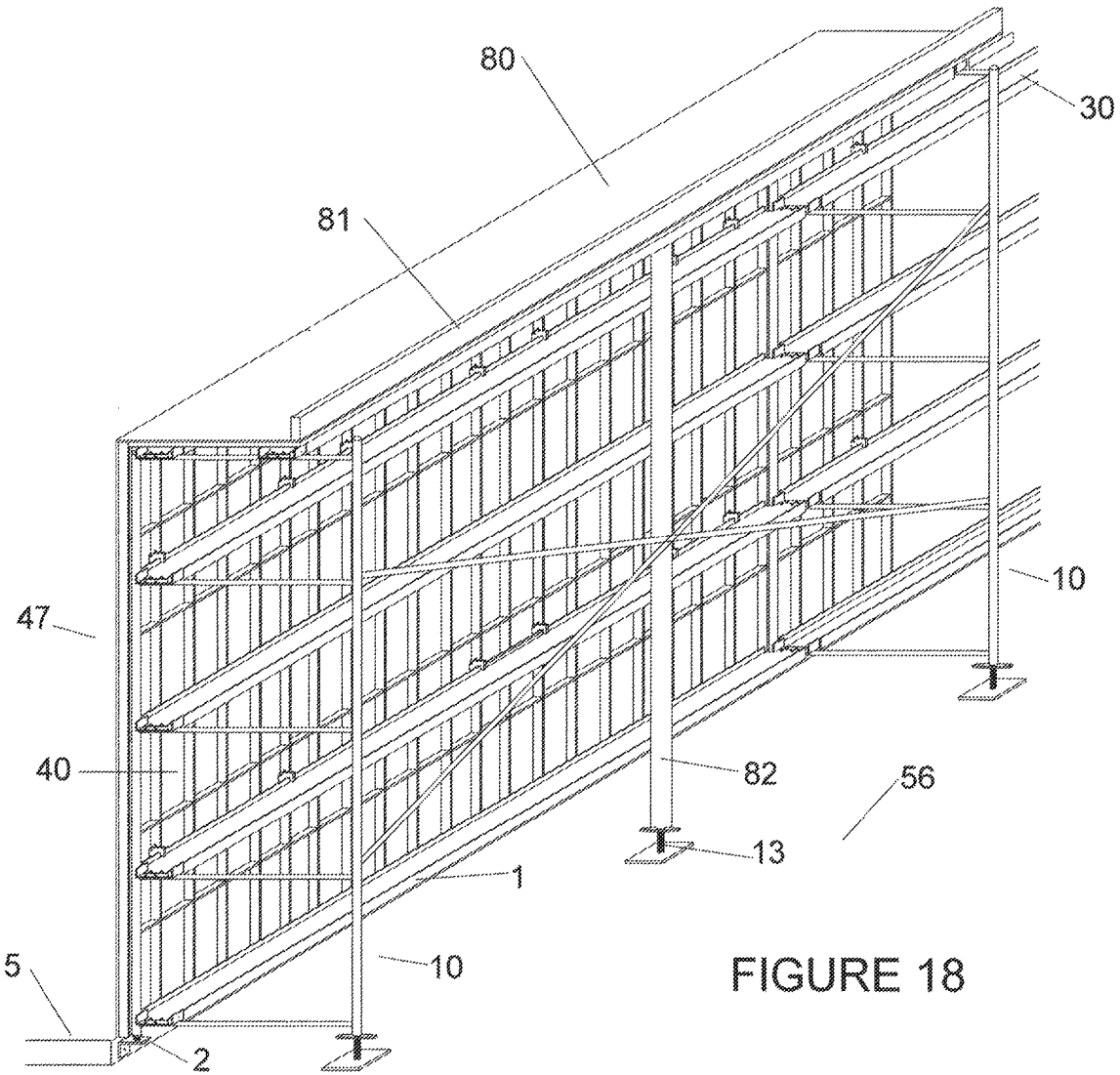
FIG. 18 shows the scaffold forming system supporting a soffit form.

Another embodiment of the scaffold forming system is that the scaffold frames can be used as shoring for concrete roofs or ceiling/floors. FIG. 18 shows a soffit form 80 on top of a scaffold frame 10 positioned on the exterior side 56 of the wall to be cast. The soffit form 80 has a side form 81 and can be cast at the same time the walls are being cast or at a later time. In addition, the soffit form 80 maybe cast alone or in combination with the remaining eave or the entire roof.

The soffit form can also be positioned on the interior side 55 of the wall and thereby used as part of the shoring and forming for a ceiling/floor cast above it. In this case the walls would be cast first and then the casting would proceed to the ceiling/floor area above the scaffold frames.

Figure 19:
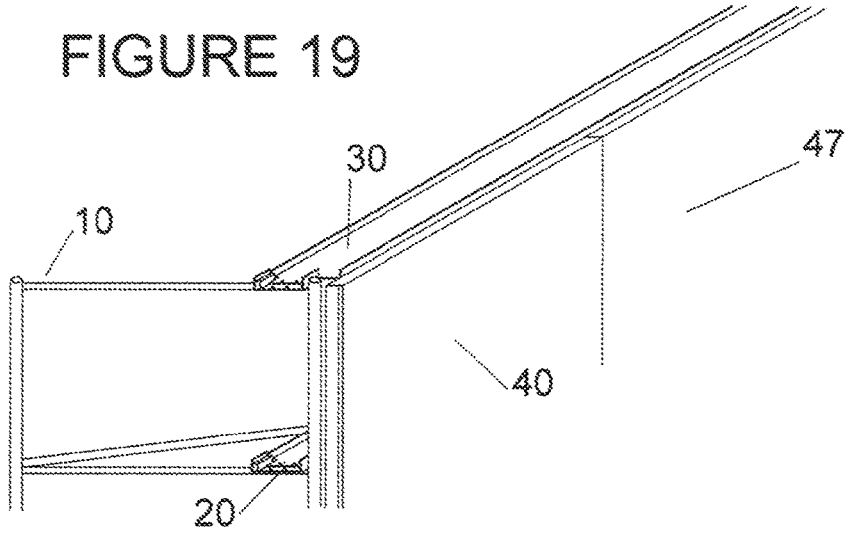
FIG. 19 shows two forms butted together and an obstruction free form face.

The forms of this invention rely upon the base braces, walers and an optional top clamp for lateral pressure support and do not use form ties. The elimination of form ties produces an obstacle free form face 47 on or between the forms 40 as shown in FIG. 19. This eliminates a thermal bridge created by form ties left inside the concrete and/or eliminates the need to patch form tie holes. It also enables the use of large, penetration free removable form liners or stay-in-place claddings.

In another embodiment of this invention, the two form sides may be connected together at the top of the forming system, above the forms, with a top clamp 90. FIG. 20 shows a top clamp 90 that connects the interior side 55 to the exterior side 56 above the forms 40. This top clamp 90 may be necessary when the cast concrete exerts higher levels of hydrostatic pressure and requires that the scaffold frames 10 be secured at both the top and bottom of the forming system.

Although the description above contains many specifications, these should not be construed as limiting the scope of the embodiments but as merely providing illustrations of some of several embodiments. Thus the scope of the embodiments should be determined by the appended claims and their legal equivalents, rather than by the examples given.

What I claim is:

1. A two sided concrete wall forming system with at least one side comprised of:

a. a plurality of base braces, aligned, positioned and secured at predetermined locations to a surface on which the wall is being cast;

b. a plurality of vertically oriented scaffold frames positioned at predetermined locations and each having two or more legs with a front leg secured by said base brace and said scaffold frames having two or more saddles spaced vertically apart;

c. said saddles have a backstop;

d. a plurality of elongated walers having front sides in vertical alignment and spanning between adjacent scaffold frames and having ends connected to said saddles and secured by said backstop;

e. a plurality of first corner walers having said front side and extending from said walers to intersect at a 90 degree angle with second corner walers and said first and second corner walers are connected;

f. a plurality of vertically oriented forms butted together and having a backside positioned against said front sides and attached to one or more said walers and said forms having an obstacle free form face;

whereby said forming system is ready for casting at least one side of a concrete wall.

2. A forming system of claim 1 further including said base brace is an elongated waler having said front side.

3. A forming system of claim 2 further including tongues at the ends of said elongated walers.

4. A forming system of claim 1 further including pins for locking said walers to said saddles.

5. A forming system of claim 1 further including said corner walers having a first end mounted onto said walers and a second end having a locking mechanism and extending from said walers to lock onto a second corner waler to form a 90 degree connection.

6. A forming system of claim 1 further including fasteners mounted on said backside that hook said forms onto said walers.

7. A forming system of claim 1 further including a top clamp connecting the two form sides together.

8. A forming system of claim 1 further including said scaffold frame having a leveling jacks on lone or more said legs.

9. A forming system of claim 1 further including the vertical stacking of said scaffold frames.

10. A forming system of claim 1 further including an obstacle free form face.

11. A forming system of claim 1 further including a soffit form positioned on top of said scaffold forms.

12. A method of forming a concrete wall with at least one side comprised of:

a. positioning a plurality of base braces, aligned and secured at predetermined locations to a surface on which the wall is being cast;

b. positioning a plurality of vertically oriented scaffold frames at predetermined locations and each having two or more legs with a front leg secured by said base brace and said scaffold frames having two or more saddles spaced vertically apart and said saddles have a backstop;

c. positioning a plurality of elongated walers having front sides in vertical alignment and spanning between adjacent scaffold frames and having ends connected to said saddles and secured by said backstop;

d. positioning a plurality of first corner walers having said front side and extending from said walers to intersect at a 90 degree angle with second corner walers and said first and second corner walers are connected;

e. positioning a plurality of vertically oriented forms butted together and having a backside placed against said front sides and attached to one or more said walers and said forms having an obstacle free form face;

whereby said forming system is ready for casting at least one side of a concrete wall.

13. A method of forming a concrete wall of claim 12 further including said base brace is an elongated waler having said front side.

14. A method of forming a concrete wall of claim 12 further including said corner walers having a first end mounted onto said walers and a second end having a locking mechanism and extending from said walers to lock onto a second corner waler to form a 90 degree connection.

15. A method of forming a concrete wall of claim 12 further including fasteners mounted on said backside that hooks said forms onto said walers.

16. A method of forming a concrete wall of claim 12 further including a top clamp connecting the two form sides together.

17. A method of forming a concrete wall of claim 12 further including an obstacle free form face.

* * * * *